United States Patent [19]

Shota

[11] Patent Number: 4,488,089

[45] Date of Patent: Dec. 11, 1984

[54] FLUORESCENT INDICATOR TUBE DRIVING CIRCUIT

[75] Inventor: Minoru Shota, Higashiosaka, Japan

[73] Assignee: Sharp Kabushiki Kaisha, Osaka, Japan

[21] Appl. No.: 467,291

[22] Filed: Feb. 17, 1983

[30] Foreign Application Priority Data

Feb. 19, 1982 [JP] Japan ..... 57-26652

[51] Int. Cl.[3] ..... H05B 39/00; H05B 41/36

[52] U.S. Cl. ..... 315/106; 340/767; 315/107; 315/169.1

[58] Field of Search ..... 315/101, 106, 107, 169.1, 315/169.3; 313/397; 340/767, 760, 775

[56] References Cited

U.S. PATENT DOCUMENTS 4,158,794 6/1979 Sandler ..... 315/169.1

*Primary Examiner*—Saxfield Chatmon

*Attorney, Agent, or Firm*—Birch, Stewart, Kolasch & Birch

[57] ABSTRACT

A plurality of heater elements are heated using a DC voltage to render the display brightness of a fluorescent indicator tube uniform. A circuit comprises a first circuit for intermittently applying a heater current to the indicator tube at a predetermined interval, and a second circuit for preventing the indicator tube from developing a display during heating the heater elements.

4 Claims, 8 Drawing Figures

FLUORESCENT INDICATOR TUBE DRIVING CIRCUIT

BACKGROUND OF THE INVENTION

The present invention relates to a fluorescent indicator tube driving circuit and, more particularly, to a circuit for driving a multi-digit fluorescent indicator tube.

Conventional fluorescent indicator tubes are characterized in that they comprise a plurality of heaters(cathodes), anodes, and grids contained within a vacuum tube. Hot electrons are emitted from the cathodes by heating the heaters and are accelerated by the grids using a pulse voltage of about 20–50 v. The accelerated electrons collide against fluorescent elements on the segmented anodes to emit fluorescence. Thus, the tubes can display numerals, characters, symbols, ets., in display digits, in accordance with the shapes of the anodes.

Conventionally, the heaters connected to a multi-digit fluorescent indicator tube are in series connected. In the respective display digits, a desired electron accelerating voltage between a heater and an anodesegment, and a bias voltage between a grid and the heater can be obtained by adding a heater voltage to an anode power source and a grid bias power source, respectively. The heater voltage is related to the respective display digits as a reference point of each of the power sources.

When the heaters are heated using a DC voltage, display brightness inevitablly varys between the upper digits and the lower digits. To correct this problem conventionally, the heaters are heated using an AC voltage to render the display brightness appearance uniform.

However, this approach is disadvantageous in that an AC voltage is needed for heating the heaters.

Therefore, it is desired to enable the heaters to be heated using a DC voltage.

SUMMARY OF THE INVENTION

Accordingly, it is an object of the present invention to provide an improved fluorescent indicator tube driving circuit.

It is another object of the present invention to provide an improved multi-digit fluorescent indicator tube driving circuit in which heater means is heated using a DC voltage.

Briefly described, in accordance with the present invention, a plurality of heater elements are heated using a DC voltage in which display brightness in a multi-digit fluorescent indicator tube made uniform. The fluorescent indicator tube driving circuit of the present invention comprises first means for applying an intermittent heater current at a predetermined frequency, and second means for inhibition display by the fluorescent indicator tube during heating of the heater elements.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
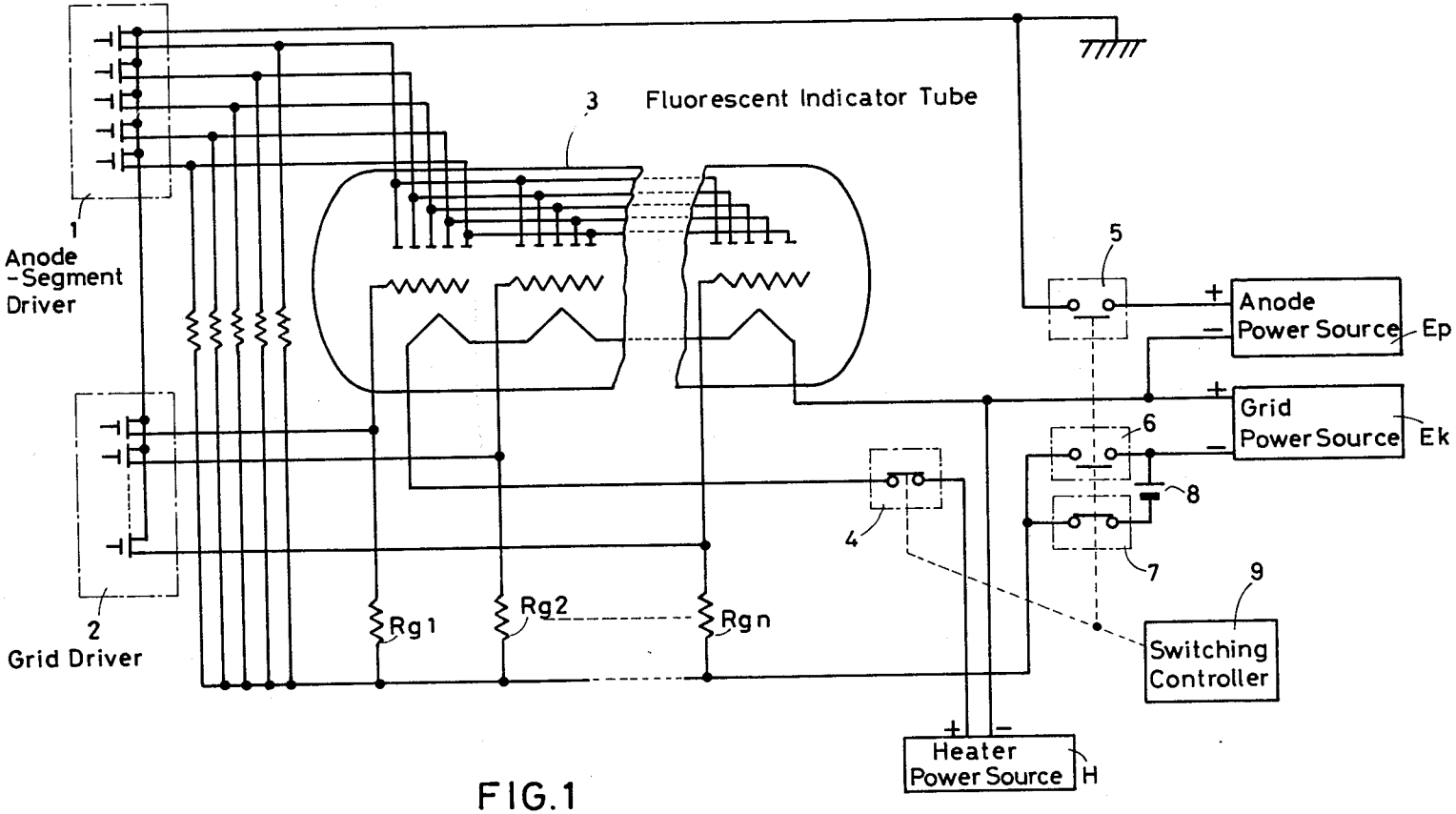
FIG. 1 shows a block diagram of a circuit for driving a multi-digit fluorescent indicator tube according to the present invention.

FIG. 1 shows a block diagram of a fluorescent indicator tube according to the present invention.

The circuit of FIG. 1 comprises an anode-segment driver 1, a grid driver 2, a fluorescent indicator tube 3, switches 4 to 6, and 7, a DC power source 8, a switching controller 9, an anode DC power source Ep, a grid DC power source Ek, and a heater DC power source H.

The tube 3 is of a multi-digit type comprising a plurality of anodes, grids, and heaters.

The b-type switch 5 is connected in the circuit for conducting an anode voltage from the anode power source Ep to the anodes of the tube 3. The a-type switch 4 is connected in the circuit for conducting a heater voltage from the heater power source H.

Herein, the a-type switch is referred to a normal close type switch and the b-type switch is referred to a normal open type switch. Preferably, the voltages of the power sources Ep, Ek, 8 and H are about 20 V, 6 V, 3 V and 3 V, respectively.

All the polarities of these power sources Ep, Ek, H and 8 can be reversed from those of the illustration of FIG. 1.

Figure 3:
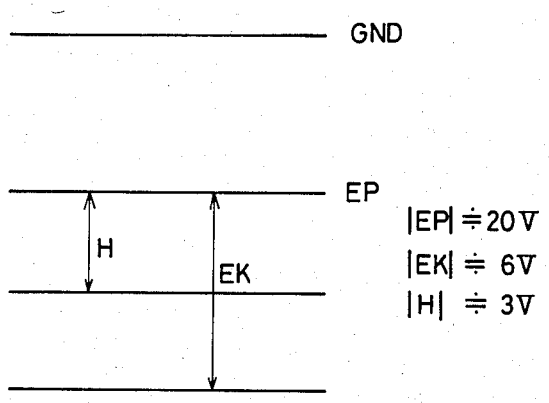
FIG. 3 shows a graph representing the relationship between DC power sources connected to the circuits of FIGS. 1 and 4.

FIG. 3 shows the relationship between the voltages of these DC power sources Ep, Ek, and H.

For the grid driver 2, the b-type switch 6 is connected in the circuit for conducting a bias voltage form the grid power source Ek, and the a-type switch 7 is connected in the circuit for conducting a negative voltage form the DC power source 8. The negative voltage of the power source 8 is greater than the grid bias voltage from the grid power source Ek. To avoid the shortcoming of the DC power source 8, the switches 6 and 7 are not conductive at the same time when they are switched.

The switching controller 9 is provided for actuating the switches 4 to 6, and 7, such that the respective switches are actuated at a frequency of, about 120 Hz or more, preferably faster than the 50 to 60 Hz frequency, of the display signals applied to the tube 3 via the anode-segment driver 1 and the grid driver 2.

When the a-type switch 4 is closed to heat the heaters in the tube 3, the b-type switch 5 is opened to remove the application of power from the anodes in the tube 3. At the same time, the negative voltage greater than the grid bias voltage is applied to the grids via the a-type switch 7, so that display by the tube 3 is prevented.

When the a-type switch 4 is nonconductive, the b-type switches 5 and 6 are made conductive, so that the tube 3 receives the anode voltage and the grid bias voltage. At this time, the heater circuit is isolated from the heater powersource H by the switch 4. However, the preheating operation which has been previously carried out enables the heaters to function as heated cathodes. Hence, the tube 3 develops a display in response to the input signals from the anode-segment driver 1 and the grid driver 2.

When the switches 4 and 7 are made conductive, the switches 5 and 6 are non-conductive. The above operations are repeated at a predetermined interval.

To ensure that the tube 3 does not develop a display during the turnoff period, the switches 6 and 7 must be operated so that the grid voltage from the grid power source Ek is turned off several milliseconds after the heater voltage from the source H is turned off.

Figure 2:
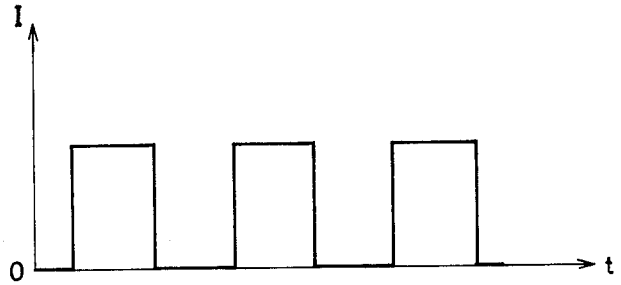
FIGS. 2(*a*), 2(*b*), and 2(*c*) show graphs representing the interrelationship of a heater current, an anode voltage, and a grid bias voltage, respectively.
Figure 2:
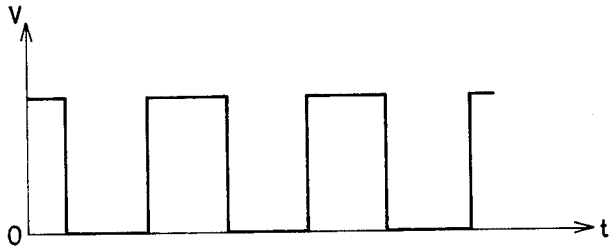
Figure 2:
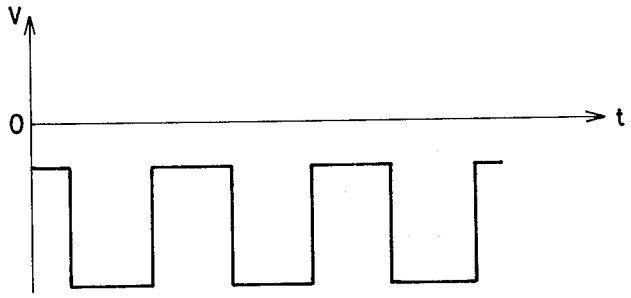

FIGS. 2(*a*), 2(*b*) and 2(*c*) show graphs representing the interrelationship between a heater current, an anode voltage, and a grid bias voltage, respectively.

In the graphs in FIGS. 2(*a*), 2(*b*) and 2(*c*), the horizontal axes are related to time.

Thus, according to the present invention, while the heater power source H is made non-conductive, the fluorescent tube 3 is operated to display. Therefore, display brightness can be rendered uniform between the respective display digits in the tube 3 even when the heater voltages are varied between the respective display digits in the tube 3.

Figure 4:
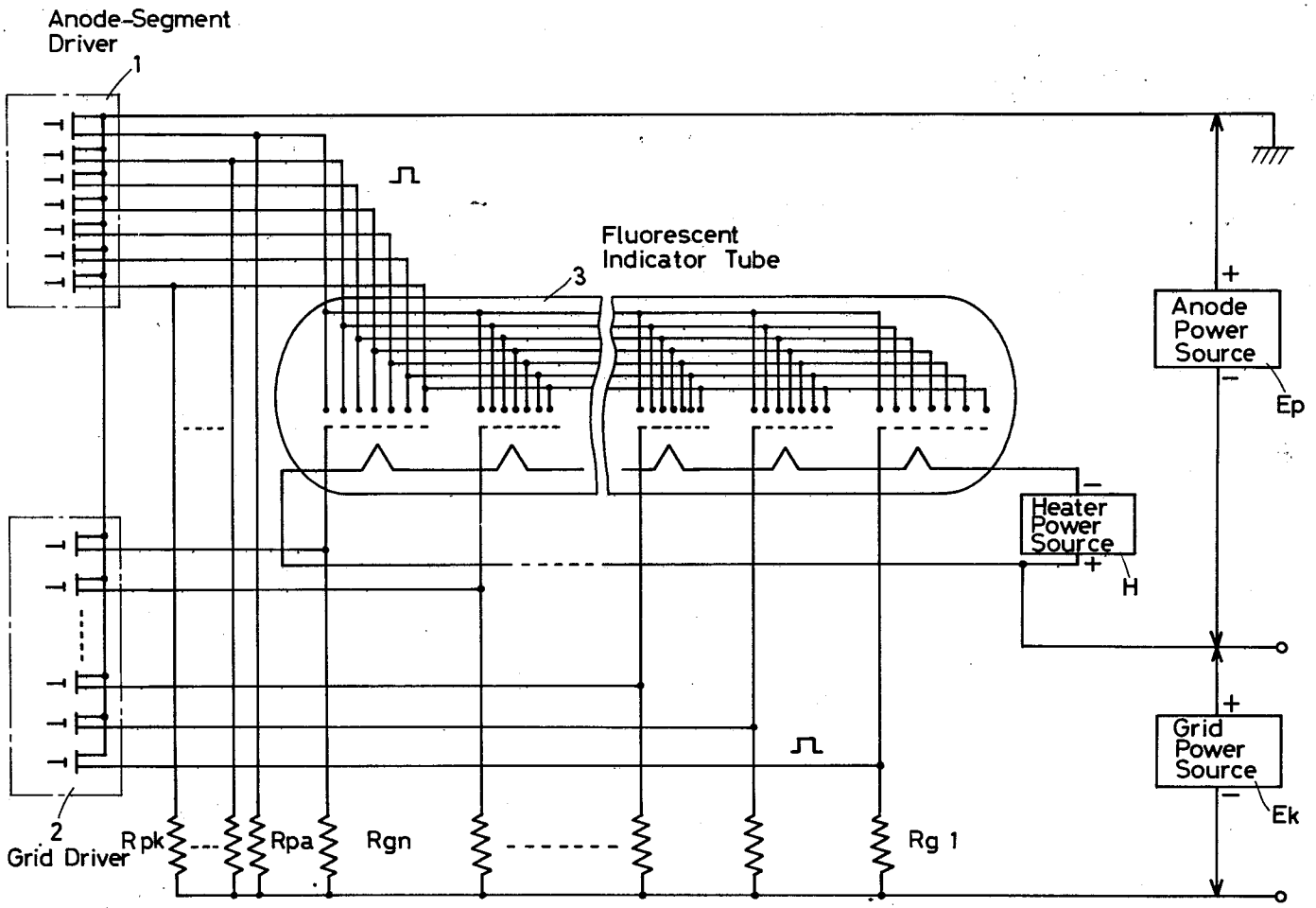
FIG. 4 shows a block diagram of another circuit for driving a multi-digit fluorescent indicator tube according to the present invention.

FIG. 4 shows a circuit of another fluorescent driving circuit according to the present invention.

Figure 5:
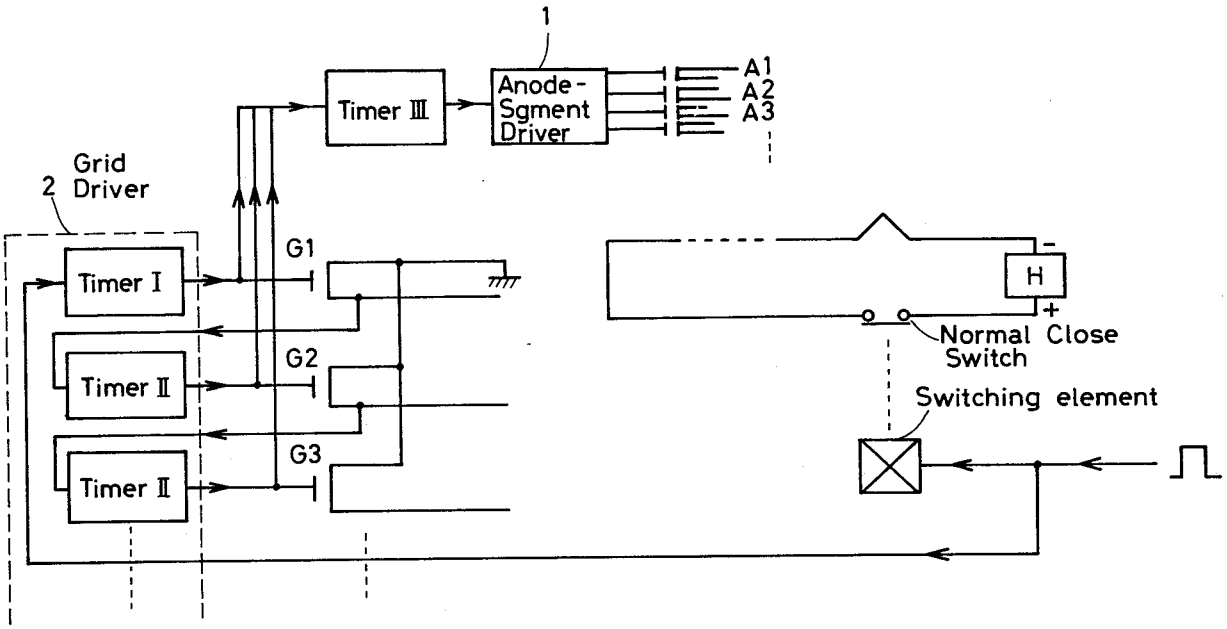
FIG. 5 shows a block diagram of a timer circuit connected to the driving circuit as shown in FIG. 4.

The circuit of FIG. 4 comprises the anode-segment driver 1, the grid driver 2, the fluorescent indicator tube 3, the anode DC power source Ep, the grid DC power source Ek, the heater DC power source H, and a timer circuit. The timer circuit is illustrated in FIG. 5. The voltage level as shown in FIG. 3 is used for the voltages of the circuit of FIG. 4.

In the circuit of FIG. 4, none of the switches 5 and 6 for switching the anode voltage and the grid voltage, and the DC power source 8, and the switch 7 for adding a voltage to the heater voltage are required whereby the respective voltages continue to be applied.

The timer circuit of FIG. 5 comprises a normal closed switch, timers, I, II and III, the anode-segment driver 1.

The timers I and II are included within the grid driver 2. The normal close switch is provided for switching the heater voltage from the heater DC power source H.

Figure 6:
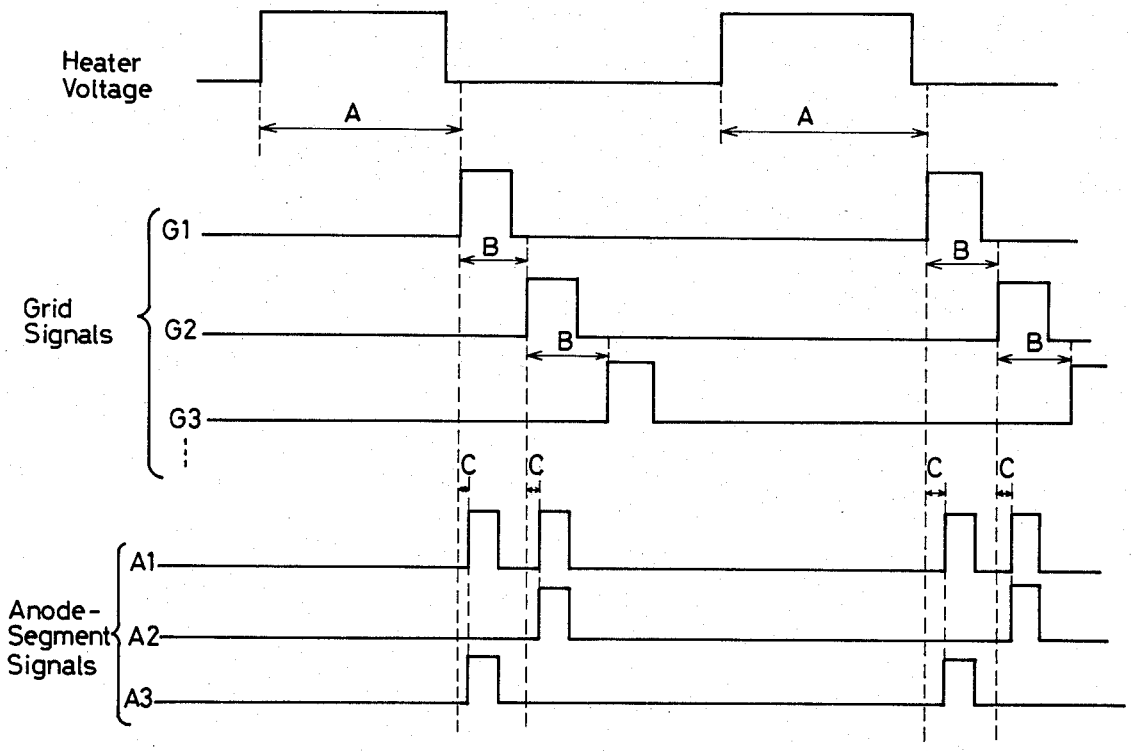
FIG. 6 shows a timing chart of signals occurring within the timer circuit of FIG. 5.

FIG. 6 shows a timing chart of signals occurring within the timer circuit of FIG. 5.

Referring to FIGS. 5 and 6, the timer I responds to the actuation of the normal close switch. Responsive to the actuation, the timer I generates a grid signal for making a grid G1 turn on when it delays by a time A of FIG. 6 from the conductive state of the heater voltage from the power source H.

Therefore, the grid G1 turns on several milliseconds (about 2 msec) later after the heater voltage turns off. The timer II is constructed so that the timer II generates a grid signal for turning a grid G2 on by a time B later after the grid signal for the grid G1 stands. Then, when the time B lapses after the grid G1 turns on, the sugsequent grids G2, G3, . . . turn on.

The timer III is provided for delaying at a time C from the generation of the respective grid signals to the generation of segment signals.

Therefore, after the respective grid signals are generated, the time C lapses when the respective segment signals are generated.

Thus, the grid signals and the anode-segment signals for selecting the display digits are subsequently developed.

The circuit of FIG. 5 achieves the same object as that of the circuit of FIG. 1. As described above, the timer circuit replaces the switches 5 and 6 for the power sources Ep and Ek.

The above embodiment of the present invention is suitable for use in a cooking apparatus such as a microwave oven.

While only certain embodiments of the present invention have been described, it will be apparent to those skilled in the art that various changes and modifications may be made therein without departing from the spirit and scope of the invention as claimed.

What is claimed is:

1. A circuit for driving a multielement fluorescent indicator tube having at least two heaters, a grid and an anode comprising:

means for periodically applying a direct current heater voltage to said heaters;

means for developing a display from said fluorescent indicator tube by applying an anode voltage between said anode and a said heater and a grid voltage between said grid and a said heater;

means for inhibiting said means for developing during application of said direct current heater voltage to said heaters by said means for periodically applying to inhibit variations in display brightness between elements of said tube;

first means for delaying the development of said grid voltage by said means for developing until after completion of the application of said direct current heater voltage to said heaters by said means for periodically applying; and second means for delaying the development of said anode voltage by said means for developing until a predetermined time after said grid voltage is fully developed thereby.

2. The circuit of claim 1 wherein said means for developing includes a negative grid power source.

3. The circuit of claim 1 wherein said circuit and said tube are utilized in a cooking apparatus.

4. The circuit of claim 1 wherein said tube is a multidigit tube.

* * * * *